US006890506B1

(12) United States Patent
Harutyunyan et al.

(10) Patent No.: US 6,890,506 B1
(45) **Date of Patent: *May 10, 2005**

(54) METHOD OF FORMING CARBON FIBERS

(75) Inventors: Avetik Harutyunyan, Columbus, OH (US); Bhabendra K. Pradhan, State College, PA (US); Peter C. Eklund, Boalsburg, PA (US)

(73) Assignee: Penn State Research Foundation, University Park, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 67 days.

(21) Appl. No.: 10/120,828

(22) Filed: Apr. 12, 2002

Related U.S. Application Data

(60) Provisional application No. 60/283,472, filed on Apr. 12, 2001.

(51) Int. Cl.[7] ..... D01F 9/12

(52) U.S. Cl. ..... 423/447.3; 423/447.1; 423/445 R

(58) Field of Search ..... 423/447.1, 447.2, 423/447.3, 445 R

(56) References Cited

U.S. PATENT DOCUMENTS

| | | | | |
|---|---|---|---|---|
| 5,165,909 | A | 11/1992 | Tennent et al. | |
| 5,780,101 | A | 7/1998 | Nolan et al. | |
| 5,872,422 | A | 2/1999 | Xu et al. | |
| 5,973,444 | A | 10/1999 | Xu et al. | |
| 6,333,016 | B1 * | 12/2001 | Resasco et al. | 423/447.3 |

FOREIGN PATENT DOCUMENTS

EP 0 056 004 1/1986

OTHER PUBLICATIONS

Sen et al. "Metal–Filled and Hollow Carbon Nanotubes Obtained by the Decomposition of Metal–Containing Free Precursor Molecules" 1997, Chemistry of Materials, vol. 9, No. 10, pp. 2078–2081.*

Huang et al. "Patterned Growth and Contact Transfer of Well–Aligned Carbon Nanotubes Films" May 7, 1999, Journal of Physica Chemistry B, vol. 103, pp. 4223–4227.*

S. Iijima, "*Helical Microtubules of Graphitic Carbon*," Nature International Weekly of Journal of Science, vol. 352, No. 6348, Nov. 7, 1991, pp. 56–60.

T.W. Ebbesen, et al "*Large–Scale Synthesis of Carbon Nanotubes*" Nature International Weekly Journal of Science, vol. 358, Jul. 16, 1992, pp. 220–222.

A. Thess, et al, "*Crystalline Ropes of Metallic Carbon Nanotubes*" Nature International Weekly Journal of Science, vol. 273, No. 6383, Jul. 26, 1996, pp. 402, 483487.

Z.F. Ren, et al, "*Synthesis of Large Arrays of Well–Aligned Carbon Nanotubes on Glass*" American Association for the Advancement of Science, vol. 282, No. 5391, No. 6, 1998, pp. 1105–1107.

M. Endo, et al, "*Pyrolytic Carbon Nanotubes From Vapor–Grown Carbon Fibers*" Carbon, Special Issue on Nanotubes, vol. 33, No. 7, 1995, pp. 873–881.

M. Terrones, et al, "*Controlled Production of Aligned–Nanotubes Bundles*" Nature International Weekly Journal of Science, vol. 388, No. 6637, Jul. 3, 1997, pp. 52–55.

P.M. Ajayan, et al, "*Aligned Carbon Nanotube Arrays Formed by Cutting a Polymer Resin–Nanotube Composite*" American Association for the Advancement of Science, vol. 265, pp., 1212–1214.

Walt A. De Heer, et al, "*Aligned Carbon Nanotube Films: Production and Optical and Electronic Properties*" American Association for the Advancement of Science, vol. 268, May 12, 1995, pp. 845–847.

W.Z. Li, et al, "*Large–Scale Synthesis of Aligned Carbon Nanotubes*" American Association for the Advancement of Science, vol. 274, Dec. 6, 1996, pp. 1701–1703.

M. Kusunoki, et al, "*Epitaxial Carbon Nanotube Film Self–Organized by Sublimation Decomposition of Silicon Carbide*" Applied Physics Letters, vol. 17, No. 13, Nov. 3, 1997, pp. 2620–2622.

R. Andrews, et al, "*Continuous Production of Aligned Carbon Nanotubes: A Step Closer to Commercial Realization*" Chemical Physics Letter, vol. 303, Apr. 16, 1999, pp. 467–474.

C. Liu, et al, "*Synthesis of Macroscopically Long Ropes of Well–Aligned Single–Walled Carbon Nanotubes*" Advanced Materials, vol. 12, No. 16, Aug. 16, 2000, pp. 1190–1192.

M. Yudasaka, et al, "*Nitrogen–Containing Carbon Nanotube Growth From Ni Phthalocyanine by Chemical Vapor Deposition*" Carbon, vol. 35, No. 2, 1997, pp. 195–201.

X.B. Wang, et al, "*Honey–Comb–Like Alignments of Carbon Nanotubes Synthesized by Pyrolysis of a Metal Phthalocyanine*" Applied Physics A Materials Science and Processing, vol. 71, No. 3, Sep. 2000, pp. 1–2.

K. Suenaga, et al, "*Radically Modulated Nitrogen Distribution in $CN_x$ Nanotubular Structures Prepared by CVD Using Ni Phthalocyanine*" Chemical Physics Letters, vol. 316, Jan. 21, 2000, pp. 3654–372.

B. K. Pradhan, et al, "*Nickel Nanowires of 4 NM Diameter in the Cavity of Carbon Nanotubes*", Chemical Communications, Royal Society of Chemistry, No. 13, Jul. 7, 1999, pp. 1153–1262.

(Continued)

*Primary Examiner*—Stuart L. Hendrickson
*Assistant Examiner*—Peter J Lish
(74) *Attorney, Agent, or Firm*—McDermott Will & Emery LLP

(57) ABSTRACT

Carbon fiber/tubes are prepared by pyrolyzing a catalyst system that contains one or more diluents to facilitate control of the diameter of the formed carbon fiber/tube.

20 Claims, 2 Drawing Sheets

OTHER PUBLICATIONS

S. Fan, et al, "*Self–Oriented Regular Arrays of Carbon Nanotubes and Their Field Emission Properties*" vol. 283, Jan. 22, 1999, pp. 512–514.

C.J. Lee, et al, "*Synthesis of Uniformly Distributed Carbon Nanotubes on a Large Area of Si Substrates by Thermal Chemical Vapor Deposition*" Applied Physics Letters, vol. 75, No. 12, Sep. 20, 1999, pp., 1721–1723.

Z.F. Ren, et al, "*Growth of a Single Freestanding Multiwall Carbon Nanotube on Each Nanonickle Dot*" Applied Physics Letters, vol. 75, No. 8, Aug. 23, 1999, pp. 1086–1088.

C. Park, et al, "*Catalytic Behavior of Graphite Nanofiber Supported Nickel Particles. 2. The Influence of the Nanofiber Structure*" The Journal of Physical Chemistry B, vol. 102, 1998, pp. 5168–5177.

R. Gao, et al, "*Kinetically Controlled Growth of Helical and Zigzag Shapes of Carbon Nanotubes*", The Journal of Physical Chemistry B, vol. 104, 2000, pp. 1227–1234.

A.R. Harutyunyan, et al, "*Hyperfine Structure in the EPR Spectra of an Organometallic Magnet Based on Doped Cobalt Phthalocyanine*" Chemical Physics Letters, vol. 246, No. 6, Dec. 6, 1995, pp., 615–618.

P.C. Eklund, et al, "*Vibrational Modes of Carbon Nanotubes,; Spectroscopy and Theory*" Carbon, vol. 33, No. 5, 1995, pp. 959–972.

J. M. Assour, et al, "*Electron Spin Resonance of α– and β–Cobalt Phthalocyanine*" Journal of the American Chemical Society, vol. 87, No. 2, Jan. 20, 1965.

"Nickel nanowires of 4 nm diameter in the cavity of carbon nanotubes", Bhabendra K. Pradhan et al., Chem. Commun., 1999, pp. 1317–1318.

* cited by examiner

METHOD OF FORMING CARBON FIBERS

RELATED APPLICATION

The present application claims priority to U.S. Provisional Application Ser. No. 60/283,472 filed 12 Apr. 2001 and entitled "METHOD FOR CONTROLLING THE DIAMETER OF CARBON NANOTUBES", the entire disclosure of which is hereby incorporated in its entirety herein by reference.

FIELD OF THE INVENTION

The present invention relates to a method for the production of elongated carbonaceous articles, such as carbon fibers and nanotubes. The present invention has particular applicability in manufacturing carbon nanotubes having variously sized diameters.

BACKGROUND

Carbon-based materials, in general, enjoy wide utility due to their unique physical and chemical properties. Recent attention has turned to the use of elongated carbon-based structures, such as carbon filaments, carbon tubes, and in particular nanosized carbon structures. It has been shown that these new structures impart high strength, low weight, stability, flexibility, good heat conductance, and a large surface area for a variety of applications.

Of growing commercial interest is the use of single-wall carbon nanotubes to store hydrogen gas, especially for hydrogen-powered fuel cells. Other applications for carbon fiber/tubes materials include catalyst supports, materials for manufacturing devices, such as a tip for scanning electron microscopes, electron field emitters, capacitors, membranes for filtration devices as well as materials for batteries.

The formation of carbon filaments through catalytic decomposition of hydrocarbons is known. For example, U.S. Pat. No. 5,165,909 to Tennent et al., disclose the production of carbon fibrils characterized by a substantially constant diameter and a length greater than about 5 times the diameter by continuously contacting metal particles with a gaseous, carbon-containing compound to catalytically grow the fibrils. European Patent 56,004B1 to Yates et al. discloses methods of preparing iron oxides for the production of carbon filaments. U.S. Pat. No. 5,780,101 to Nolan et al. discloses methods of producing highly crystalline nanotubes by the catalytic disproportionation of carbon monoxide in the substantial absence of hydrogen.

U.S. Pat. Nos. 5,872,422 and 5,973,444 both to Xu et al. disclose carbon fiber-based field emission devices, where carbon fiber emitters are grown and retained on a catalytic metal film as part of the device. Xu et al. disclose that the fibers forming part of the device may be grown in the presence of a magnetic or electric field, as the fields assist in growing straighter fibers.

Additional conventional synthesis methods for carbon nanotubes include carbon arc discharge (S. Iijima, Nature, 354, 56, 1991) and catalytic pyrolysis of hydrocarbon (M. Endo, K. Takeuchi, S. Igarashi, K. Kobori, M. Shiraishi, H. W. Kroto, J. Phys. Chem. Solids, 54, 1841, 1993), which generate nanotubes often containing traces of the catalyst particles used to generate them and possessing highly variable dimensions. Synthesis of aligned nanotube by pyrolysis of hydrocarbon with a patterned cobalt catalyst on silica substrate was reported by M. Terrones et al, Nature, 388, 52, 1997 and with iron nanoparticles in mesoporous silica by W. Z. Li et al, Science, 274, 1701, 1996. The successful production of carbon nanotubes in an alumina template by pyrolysis of propylene has been disclosed by T. Kyotani, L. Tsai, A. Tomita, Chem. Mater., 8, 2190, 1996.

Despite efforts in preparing carbon fiber/tubes, limited progress has been realized in controlling the diameters of these materials, particularly controlling the diameter of carbon nanotubes. Accordingly, a need exists for the manufacture of carbon fiber/tubes, in particular nanosized carbon-based fiber/tubes, with improved control over the diameter of these materials.

BRIEF SUMMARY

An advantage of the present invention is a method of manufacturing carbon fiber/tubes.

Additional advantages and other features of the present invention will be set forth in the description which follows and in part will be apparent to those having ordinary skill in the art upon examination of the following or may be learned from the practice of the present invention. The advantages of the present invention may be realized and obtained as particularly pointed out in the appended claims.

According to the present invention, the foregoing and other advantages are achieved in part by a method of a manufacturing a carbon article, e.g. a carbon fiber or nanotube. The method comprises preparing a metal catalyst system having one or more diluents; and pyrolyzing the metal catalyst system to form the carbon fiber/tube. The diluents can be non-metal ligands, i.e. metal-free organic compounds such as chelators.

Embodiments include preparing a metal catalyst system by adding a non-metal diluent to a metal catalyst, e.g. adding a phthalocyanine or derivative thereof to a nickel phthalocyanine metalorganic to form the metal catalyst system, and pyrolyzing the metal catalyst system from about 100° C. to about 1000° C.

Another aspect of the present invention includes a method of controlling the diameter of a carbon fiber/tube. The method comprises preparing a metal catalyst system by adding a diluent to a metal catalyst; and pyrolyzing the metal catalyst system to form a carbon fiber/tube with a diameter corresponding to the diluted metal catalyst.

Additional advantages of the present invention will become readily apparent to those skilled in this art from the following detailed description wherein embodiments of the present invention are described simply by way of illustrated of the best mode contemplated for carrying out the present invention. As will be realized, the present invention is capable of other and different embodiments, and its several details are capable of modifications in various obvious respects, all without departing from the present invention. Accordingly, the drawings and description are to be regarded as illustrative in nature, and not as restrictive.

BRIEF DESCRIPTION OF THE DRAWINGS

The various features and advantages of the present invention will become more apparent and facilitated by reference to the accompanying drawings, submitted for purposes of illustration and not to limit the scope of the invention, where the same numerals represent like structure and wherein.

DESCRIPTION OF THE INVENTION

Figure 1A:
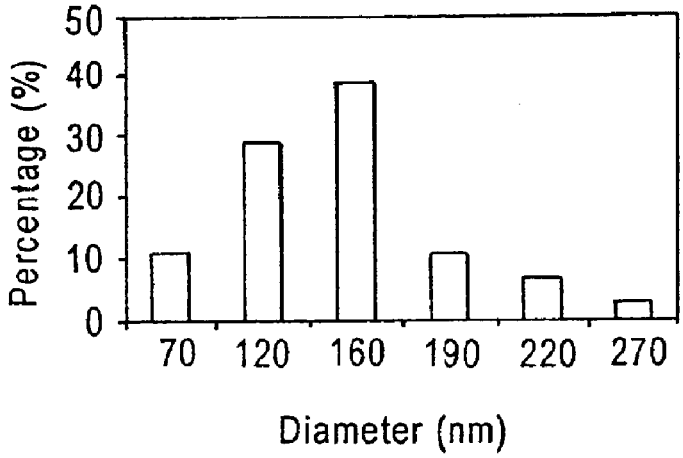
FIG. 1 illustrates a series of histograms showing the distribution of the diameters of carbon fiber/tubes obtained by pyrolysis using (a) a nickel phthalocyanine (NiPc) metalorganic, (b) a NiPc metalorganic diluted with 75% of phthalocyanine; and (c) a NiPc metalorganic diluted with 92% of phthalocyanine.

The present invention contemplates a new technique of forming carbon-based structures, e.g. carbon fiber/tubes, with a certain degree of control over the diameter of the formed carbon structure. The carbon articles manufactured in accordance with the present invention can take any elongated form, such as that of a fiber/tube, fibril, filament etc. It is understood that the terms "carbon filaments", "carbon whiskers", "carbon fibers", and "carbon fibrils", are sometimes used interchangeably by those in the art, all of which however, are herein contemplated by the present invention. The elongated forms can be of any morphology, such as straight, branched, twisted, spiral, helical, coiled, ribbon-like, etc. and have a length of a few nanometers (nm) to several hundred microns.

The inner core of these articles can be solid, hollow or can contain carbon atoms that are less ordered than the ordered carbon atoms of the outer region. The carbon article of the present invention can be in the form of a tube, and in the size of a carbon nanostructure such as those selected from nanotubes, single-walled nanotubes, hollow fibrils, nanoshells, etc. The nanostructures used in the present invention can have a cross-section or diameter of less than 1 micron, e.g. from about 0.1 nm to less than 1,000 nm, e.g., from about several nanometers to about 500 nm. In en embodiment of the present invention the cross-section of a nanostructured carbon article is from about 20 nm to about 200 nm.

In part, the type of carbon article formed depends on the type and nature of the catalyst used in the process. For example a nanosized catalyst, i.e. a catalyst having a displacement of less than one micron, can form a nanosized structure. Carbon articles can be formed by pyrolysis of a carbon source in the presence of a catalyst. In an embodiment of the present invention, the carbon source is a component of the catalyst system. For example, carbon nanotubes can be made by pyrolysis of a metalorganic compound, such as a nickel phthalocyanine (NiPc), where the organic component of the metalorganic compound provides the source of carbon used to generate the carbon structure. This method advantageously permits the preparation of well-aligned carbon fiber/tubes over large areas and on different substrates.

Through experimentation and investigation, it was discovered that by diluting the catalyst, i.e. adding additional components to a catalyst comprising at least one metal, the diameter of the resulting carbon structure formed from the diluted catalyst can be reduced. It is believed that the addition of components to the catalyst results in an increased distance between metal atoms in the composition, i.e. there is a decreased concentration of metal atoms per unit volume. Pyrolysis thereafter results in smaller metal clusters. Since carbon fiber/tubes are believed to be grown from the metal clusters, decreasing their size, in turn, results in smaller diameters of the formed carbon fiber/tubes. Hence, dilution provides a systematic method of controlling the diameter size of carbon structures formed therefrom.

In accordance with the present invention, the catalyst should be capable of being diluted by the addition of one or more components or their equivalents. Suitable catalysts include, for example, transition metal-based catalyst, such as chromium, molybdenum, iron, nickel, cobalt, etc. and alloys thereof. In one aspect of the present invention, the catalyst comprises an iron, nickel or cobalt metal with one or more ligands, such as a phthalocyanine (Pc) ($C_{32}H_{16}N_g$) or a derivative thereof, e.g. ($C_{32}H_{16}N_8\ R_x$) where R is an alkyl or ether or ester, etc. as is known in the arts and "x" is the number of times R occurs in the compound as is also known in the art. It is also contemplated that the R substituent can differ at different locations on the ligand. In this case, the metal can be diluted with additional ligands, i.e. a metal free diluent, such as the addition of Pc to a nickel catalyst. In one aspect of the present invention, the diluents are chelators that are commonly used as ligands in metal complexes. These catalysts can be prepared by conventional techniques as known in the art.

The catalyst can be deposited on chemically compatible supports. Such supports should not poison the catalyst, should be easily separated if necessary from the carbon products after they are formed. In an embodiment of the present invention, the catalyst is supported on a chemically compatible porous substrate, such as a refractory support. Alumina, carbon, quartz, silicates, and aluminum silicates such as mullite may be suitable support materials.

In practicing an embodiment of the present invention, carbon articles can be formed in a chamber containing an inert and/or reducing gas by heating the diluted catalyst at elevated temperatures for an effective amount of time. By an effective amount of time, it is meant the amount of time needed to produce the desired elongated structure. This amount of time will generally be from about several seconds to as long as several days depending upon the diluent, catalyst, and desired article. Heating the diluted catalyst at sufficient temperatures causes it to decompose and causes carbon deposits to form on the metal components in the catalyst. Continued heating causes the continued deposition of carbon and the growth of an elongated article.

The reaction temperature should be high enough to cause the catalyst to form carbon materials. The precise temperature limits will depend on the specific catalyst system used. In an embodiment of the present invention, the chamber is maintained at a temperature from the decomposition temperature of the carbon-containing compound to the deactivation temperature of the catalyst. Generally, this temperature will range from about 100° C. to about 1000° C., and preferably from about 500° C. to about 850° C.

EXAMPLE

An example of forming a carbon nanotube with various sized diameters was undertaken. In this example, NiPc was prepared with metal-free Pc ($H_2Pc$) and used as both a catalyst and a carbon source at the same time. As a further example of metal diluents, the present invention also contemplates catalyst systems that are diluted by the addition of metal diluents. For example, composition having $(M_1Pc)_x(M_2Pc)_{1-x}$ where $M_1$ and $M_2$ are different metals are also contemplated.

In this example, phthalocyanines were purified by twice subliming the sample at about 480° C. under vacuum. This produces predominately the beta form of MPc (where M is a metal), the more stable of its polymorphic forms. Diluted catalyst systems were prepared by subliming a predetermined mixture of NiPc with $H_2Pc$ powders in a desired proportion to yield $(NiPc)_x(H_2Pc)_{1-x}$. Three different catalysts were prepared where x is 1, 0.25 and 0.08 by this method.

Carbon nanotubes were then formed by pyrolyzing the catalyst systems. Pyrolysis was carried out under a atmosphere of argon and hydrogen (1:1 v/v) at a flow of about 40 cc/min in a quartz flow reactor. This particular reactor comprised a two-zone electrical furnace with independent temperature control for each zone. A quartz substrate was placed in the reactor which was previously cleaned by sonication in ethanol prior to pyrolysis. The source material was then placed in the first zone for vaporization. Initially, the first zone was heated to about 480–520° C., while the second zone was heated to about 800–920° C. After about 10–20 minutes, the temperature of the first zone was increased to that of the second zone and temperature was maintained for an additional 15–30 minutes. The reactor was then cooled to room temperature under an argon atmosphere. The carbon deposit was then separated from the substrate. The carbon deposit could be separated by scrapping which resulted in a powder or by immersing the substrate into an hydrofluoric acid bath which resulted in a film of the material.

After isolating the carbon mass, characterization thereof showed that the diameter of the formed carbon fiber/tubes depended on the degree of dilution of the metal in the catalyst system. For example, carbon nanotube diameters grown by pyrolysis of (a) NiPc; (b) $(NiPc)_{0.25}(H_2Pc)_{0.75}$; and (c) $(NiPc)_{0.08}(H_2Pc)_{0.92}$ showed a progressive decrease in the size.

Figure 1B:
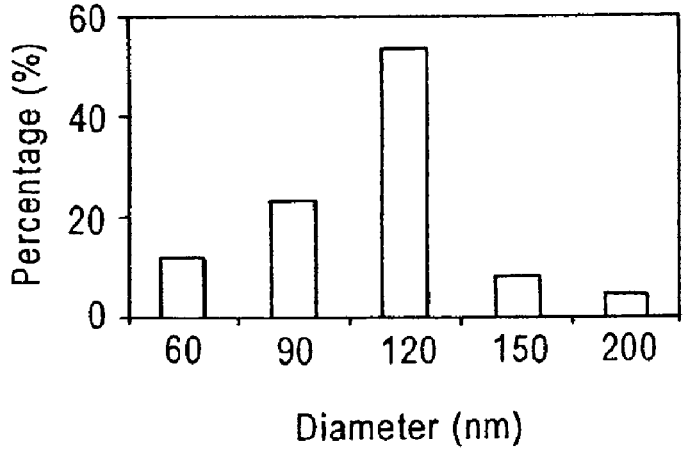
Figure 1C:
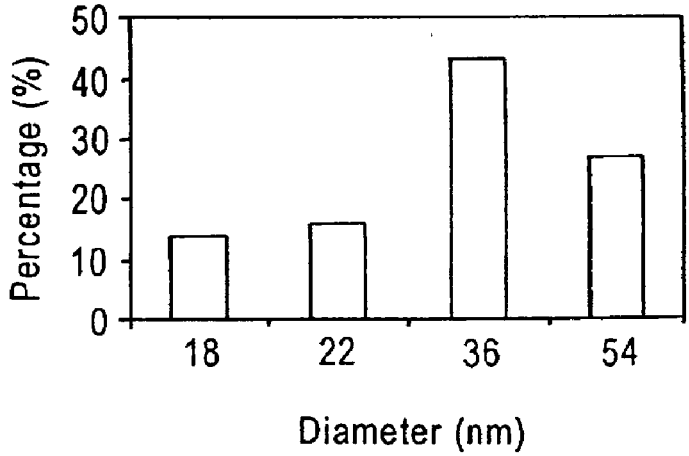
Figure 2:
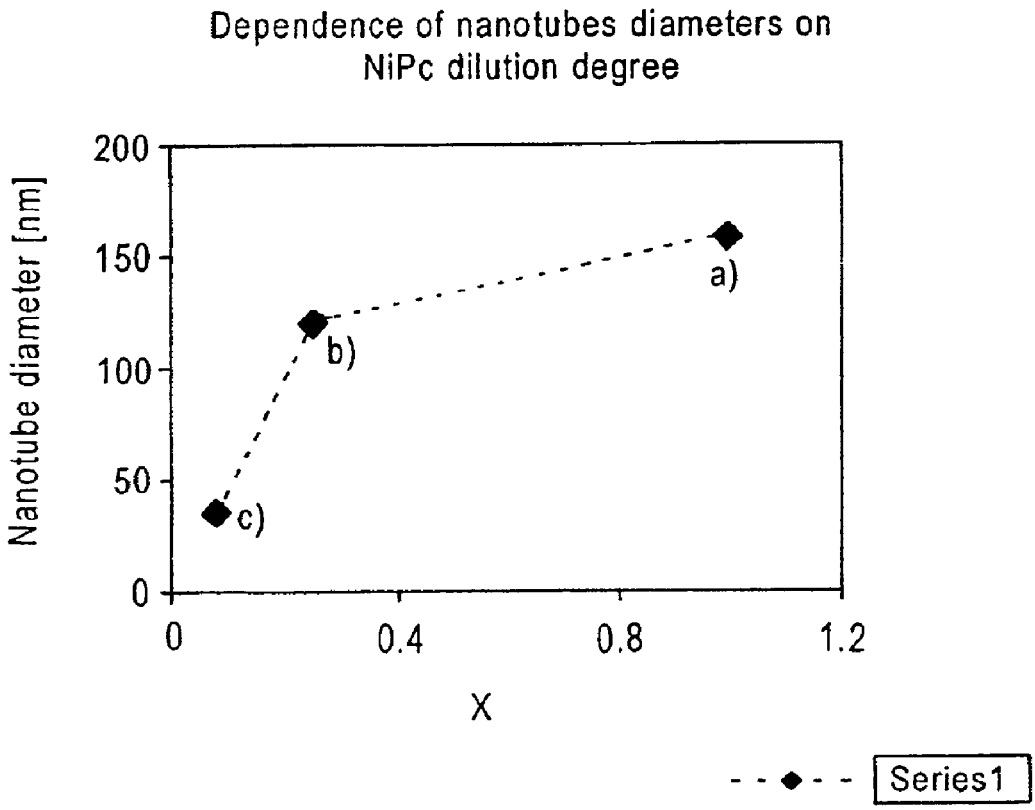
FIG. 2 is a chart showing the relationship between the average diameter of carbon nanotubes to the degree of dilution of the catalyst from which the carbon nanotubes were produced.

FIGS. 1*a–c* illustrate histograms of nanotube diameter distributions estimated from high resolution scanning electron micrographs for grown from the pyrolysis of catalyst systems (a), (b) and (c). As illustrated in FIGS. 1*b–c*, the higher dilution, the lower the diameter of the formed carbon nanotube. The decrease in diameters is further illustrated by the chart in FIG. 2 which plots the approximate correlation between "x" the amount of dilution for this particular system and the corresponding diameter of the formed carbon nanotube.

Although the present example has been described where the carbon source is a component of the catalyst system, additional external carbon sources can be added. For example, a carbon containing precursor, e.g. a $C_{1-18}$ hydrocarbon, can be introduced to the chamber and in contact with the catalyst with the application of heat. This can occur before, during and/or after pyrolysis of the catalyst system. Also additional materials and/or conditions can be included to optimize this system without departing from the scope or spirit of the present invention.

The present invention enjoys industrial applicability in manufacturing various types of carbon structures, particularly carbon nanotubes with a degree of control over the diameter of the nanotube. In the preceding detailed description, the present invention is described with reference to specifically exemplary embodiments thereof. It will, however, be evident that various modifications and changes may be made thereto without departing from the broader spirit and scope of the present invention, as set forth in the claims. The specification and drawings are, accordingly, to be regarded as illustrative and not restrictive. It is understood that the present invention is capable of using various other combinations and environments and is capable of changes or modifications within the scope of the inventive concept as expressed herein.

What is claimed is:

1. A method of forming a carbon fiber/tube, the method comprising:

providing a metalorganic, which contains a metal and a source of carbon for incorporation into a carbon fiber/tube upon pyrolysis;

combining a diluent with the metalorganic to form a diluted metalorganic, wherein the diluent comprises phthalocyanine or a derivative thereof; and pyrolyzing the diluted metalorganic to form the carbon fiber/tube.

2. The method according to claim 1, wherein the metalorganic is subjected to a purification step prior to being combined with the diluent.

3. The method according to claim 1, comprising isolating the formed carbon fiber/tube.

4. The method according to claim 1, wherein the metal comprises iron, nickel or cobalt.

5. The method according to claim 1, comprising pyrolyzing the diluted metalorganic at a temperature from about 100° C. to about 1000° C.

6. The method according to claim 1, comprising forming a carbon fiber/tube having a cross-section of less than one micron.

7. The method according to claim 1 further comprising:

controlling the diameter of the carbon fiber/tube by adjusting the amount of diluent added to the metalorganic.

8. The method according to claim 7, comprising reducing the diameter of the formed carbon fiber/tube by increasing the amount of diluent.

9. The method according to claim 7, comprising isolating the formed carbon fiber/tube.

10. The method according to claim 7, comprising pyrolyzing the diluted metalorganic at a temperature from about 100° C. to about 1000° C.

11. The method according to claim 7, wherein the formed carbon fiber/tube has a cross-section of less than one micron.

12. A method of controlling the diameter of a carbon fiber/tube, the method comprising:

diluting a catalyst of formula $(M_1Pc)$ with a diluent comprising phthalocyanine or a derivative thereof, where $M_1$ is a metal and Pc is a phthalocyanine or a derivative thereof; and pyrolyzing the diluted catalyst to form a carbon fiber/tube with a diameter corresponding to the concentration of the metal in the diluted catalyst.

13. The method according to claim 12, comprising diluting the catalyst by adding a non-metal diluent.

14. The method according to claim 12, comprising diluting the catalyst with a non-catalytic metal diluent.

15. The method according to claim 12, wherein $M_1$ is nickel, iron, or cobalt.

16. The method according to claim 15, comprising diluting the nickel, iron or cobalt based catalyst by adding a metal free phthalocyanine to the metal catalyst.

17. The method according to claim 12, comprising purifying the diluted catalyst prior to pyrolysis.

18. The method according to claim 12, comprising separating the formed carbon fiber/tube from the catalyst.

19. The method according to claim 12, comprising pyrolyzing the diluted catalyst at a temperature from about 100° C. to about 1000° C.

20. The method according to claim 12, comprising forming a carbon fiber/tube having a cross-section of less than one micron.

* * * * *